US007471801B2

(12) United States Patent
Håkansson

(10) Patent No.: US 7,471,801 B2
(45) Date of Patent: Dec. 30, 2008

(54) DEVICE FOR THE GENERATION OF OR MONITORING OF VIBRATIONS

(75) Inventor: Bo Håkansson, Göteborg (SE)

(73) Assignee: Osseofon AB, Gothenburg (SE)

( * ) Notice: Subject to any disclaimer, the term of this patent is extended or adjusted under 35 U.S.C. 154(b) by 0 days.

(21) Appl. No.: 10/983,015

(22) Filed: Nov. 5, 2004

(65) Prior Publication Data

US 2005/0135651 A1 Jun. 23, 2005

Related U.S. Application Data

(63) Continuation of application No. PCT/SE03/00751, filed on May 12, 2003.

(30) Foreign Application Priority Data

May 10, 2002 (SE) ..... 0201441

(51) Int. Cl.
*H04R 25/00* (2006.01)

(52) U.S. Cl. ..... 381/326; 381/407; 381/419

(58) Field of Classification Search ..... 381/152, 381/326, 380, 407, 417–418, 419–420; 128/1 R; 600/25; 607/55–57; 623/10
See application file for complete search history.

(56) References Cited

U.S. PATENT DOCUMENTS

| | | | | |
|---|---|---|---|---|
| 3,838,216 | A * | 9/1974 | Watkins | 381/117 |
| 3,867,587 | A * | 2/1975 | Yamamuro | 381/414 |
| 4,631,430 | A * | 12/1986 | Aubrecht | 310/12 |
| 5,349,741 | A * | 9/1994 | Neuenschwander | 29/598 |
| 5,528,697 | A | 6/1996 | Saito | |
| 6,217,508 | B1 * | 4/2001 | Ball et al. | 600/25 |
| 6,475,134 | B1 * | 11/2002 | Ball et al. | 600/25 |
| 6,676,592 | B2 * | 1/2004 | Ball et al. | 600/25 |
| 6,751,334 | B2 * | 6/2004 | Hakansson | 381/396 |
| 6,985,599 | B2 * | 1/2006 | Asnes | 381/326 |
| 2003/0034039 | A1 | 2/2003 | Schmid et al. | |
| 2003/0034705 | A1 | 2/2003 | Hakansson | |
| 2003/0060676 | A1 * | 3/2003 | Ball et al. | 600/25 |
| 2003/0114999 | A1 * | 6/2003 | Shimoda et al. | 702/56 |
| 2004/0028249 | A1 * | 2/2004 | Asnes | 381/151 |
| 2004/0057588 | A1 * | 3/2004 | Asnes | 381/151 |
| 2005/0236952 | A1 * | 10/2005 | Kusase et al. | 310/168 |
| 2006/0041318 | A1 * | 2/2006 | Shannon | 623/23.46 |
| 2006/0045298 | A1 * | 3/2006 | Westerkull | 381/326 |

FOREIGN PATENT DOCUMENTS

| | | |
|---|---|---|
| JP | 02260612 | 10/1990 |
| JP | 11146480 | 5/1999 |
| JP | 11146486 | 5/1999 |

(Continued)

*Primary Examiner*—Curtis Kuntz
*Assistant Examiner*—Phylesha Dabney
(74) *Attorney, Agent, or Firm*—Gauthier & Connors LLP

(57) ABSTRACT

The present invention relates to an electromagnetic vibrator of variable reluctance type, according to a new principle which provides higher efficiency, smaller dimension, and higher reliability compared to known technology. This has been obtained by that the magnetic signal flux generated by the coil is closed through a bobbin body and one or more yokes, and wherein the bobbin body and the yokes are made of laminated metal sheets having good magnetic properties.

8 Claims, 4 Drawing Sheets

FOREIGN PATENT DOCUMENTS

| | | |
|---|---|---|
| JP | 2000308183 | 11/2000 |
| JP | 2001015330 | 1/2001 |
| SE | 514 929 | 5/2001 |
| SE | 514 930 | 5/2001 |
| WO | WO 97/09858 | 3/1997 |
| WO | WO 03/020360 | 3/2003 |

* cited by examiner

DEVICE FOR THE GENERATION OF OR MONITORING OF VIBRATIONS

This is a continuation of copending application(s) International Application PCT/SE03/00751 filed on 12 May 2003 and which designated the U.S.

TECHNICAL FIELD

The present invention relates to a new solution of the construction of electro magnetic vibrators of variable reluctance design which provides improved efficiency and improved optimization possibilities, in particular to a device for the generation of or monitoring of vibrations according to the principle of variable reluctance comprising a coil for generating/monitoring a magnetic signal flux, a bobbin body of a magnetic flux conducting material, one or more yokes of a magnetic flux conducting material and one or more permanent magnets for the generation of magnetic biasing flux.

BACKGROUND OF THE INVENTION

Electro magnetic vibrators of the variable reluctance principle are used i.a., in bone conduction hearing aids and audiometric vibrators for determining hearing thresholds. It is important that such vibrators are: efficient, small, reliable, and are designed in such a way that their properties can be adapted to the particular application. In order to improve conventional bone conduction vibrators with regard hereto the technology has been developed i.a., by means of the invention according to SE 0000810-2.

In spite of improvements in different regards these vibrators suffer from losses, which arise in particular in the iron material conducting the dynamic magnetic flux. These losses may even be larger in the improved constructions described in SE 0000810-2 compared to conventional vibrators of the variable reluctance type.

The losses, which predominantly occur due to eddy currents lead to a deteriorated efficiency and in many cases to an undesired heating up of the iron material. For example, the heat generation can become so high that a short circuit occurs in the windings of the coil. If the vibrator should be used in an implantable bone conduction hearing aid even a small temperature increase could be damaging to the surrounding tissue.

The present invention aims to reducing the problem of eddy currents in the iron material conducting the dynamic magnetic flux in variable reluctance vibrators for bone conduction use.

By means of the new invention a change of the electrical impedance occurs seen in the electrical terminals of the coil making it possible to optimize the function of the vibrator for different applications.

PRIOR ART

The function of a conventional vibrator of variable reluctance type (State of the Art) as well as of the improved solution having a Balanced Electro Magnetically Separated Transducer (BEST) are described in SE 0000810-2 and will not be repeated herein.

Drawbacks using variable reluctance vibrators of known designs When the dynamic magnetic flux is closed through soft iron components then losses will occur mainly in the form of eddy currents. The existence of these losses can be studied by an analysis of the electrical impedance of the coil surrounding the bobbin. These losses are characterized in that the phase of the electrical impedance levels out at the level 50 to 60 degrees, which is shown in FIG. 1. These losses tend to be neglected in conventional bone conduction vibrators (State of the Art) primarily because it is difficult to take care of them.

In the new design of the vibrator according to BEST principle these losses, however, will become more annoying, as the dynamic flux now will pass through soft iron material all the way around the coil. These losses are a great drawback in hearing aids where a high efficiency is an important feature. In particular this is important in implantable hearing aids where it is difficult to transfer energy transcutaneously (through intact skin) to the implanted unit. Further, it is important in implantable hearing aids that the vibrator itself does not become heated to unhealthy temperatures due to losses, which are converted to heat. Furthermore the bobbin body according to the new vibrator principle BEST will become more exposed than in conventional vibrators as it has to be very small and light, i.e., it has a very poor heat capacity. This is a consequence of that in BEST vibrators the coil/bobbin body is placed on the load side of the airgaps in stead of on the counter weight side as in a conventional vibrator.

Of the above description it is evident that there is a strong demand for reducing losses that arise in a variable reluctance vibrator.

SUMMARY OF THE PRESENT INVENTION

The proposed invention is a new vibrator of variable reluctance type, which is characterized in that at least the bobbin body, preferably the whole armature conducting the dynamic magnetic flux is made of laminated metal sheets having good magnetic properties with regard to the intended use.

DETAILED DESCRIPTION OF THE INVENTION

The present invention solves previously known problems, and is characterized in that the bobbin body is made of laminated sheets of a magnetic conducting material.

A preferred embodiment of the invention is characterized in that even the yokes are made of laminated sheets of a magnetic conducting material.

Another preferred embodiment is characterized in that the sheets are joined (fixed to each other) using glue that forms a layer having low electric conductivity between the sheets.

A further preferred embodiment is characterized in that the sheets are made by punching.

Another preferred embodiment is characterized in that capacitive impedance (capacitor) is connected in parallel in such a way that parallel resonance occurs in a frequency band where the vibrator is not to consume any energy, e.g., at a switch frequency or at a carrier frequency.

A further other preferred embodiment is characterized in that a capacitive impedance (capacitor) is connected in series in such a way that a series resonance is obtained in a frequency band where an efficient transformation from electrical energy to mechanical energy is to be obtained.

Another preferred embodiment is characterized in that capacitive impedance (capacitor) is connected in parallel in such a way that parallel resonance occurs and capacitive impedance (capacitor) is connected in series in such a way that a series resonance is obtained.

A further preferred embodiment is characterized in that the coil is split in two parts and that a simple cross-over network is arranged to control the distribution of energy between the coils with regard to different frequency bands.

The accumulated losses in soft iron components of the magnetic circuit in known vibrator designs are manifested in the fact that the electrical impedance become more resistive than would be the case without losses. This means that the designs of today has a phase angle of the electrical impedance that hardly exceeds 60 degrees, which is to be compared with the phase angle that can be obtained in the present invention, having a laminated bobbin body, which is about 80 to 85 degrees, cf FIG. 1B. In this new invention a more inductive characteristic of the electrical impedance is obtained which means on one hand that the eddy current losses have been reduced, on the other hand that the electrical impedance has got a higher inductance. This more purified inductive characteristic, being a concrete effect of the invention, can be utilized in such a way that the vibrator can be tailor-made to become extremely efficient in certain frequency bands, or having extremely high impedance at other frequency bands. This optimization may easily be carried out using external electrical components.

The technique using laminated cores has been tested in quite other applications, such as in transformers, electrical engines, and loud speakers for air conductance, but never for vibrators for bone conduction applications. An application where lamination of parts of the magnetic flux path has been proposed is known from U.S. Pat. No. 3,632,904. It is proposed that lamination should be used in a conventional loud speaker of "moving coil type" or "voice coil type". This loud speaker functions according to a quite different principle than vibrators of variable reluctance type. A piquant detail in connection herewith is that, as the laminations are carried out in accordance with the description and the figures of U.S. Pat. No. 3,632,904, no reduction of the eddy current losses will occur. The laminations are actually placed 90 degrees perpendicular to the signal flux, which will not reduce eddy current losses as these are induced in the same plane. In known circular symmetrical loudspeaker constructions having voice coil the lamination is difficult to carry out as these in such cases should mean cylinders having a successively changing diameter should be fitted into each other provided with isolating layers in between. In U.S. Pat. No. 3,935,398 laminations are shown in a small air loud speaker for air conduction hearing aids. Here lamination has been used for a part of the magnetic flux path, however, not to the most important part thereof, viz. the iron core circumvented by the coil. In this type of loud speakers where the bobbin core consists of in thin band form, which is the movable part of the loud speaker transferring vibrations to the air membrane lamination of the bobbin body/iron core can not be used. There are several reasons for that laminations are not used in the bone conduction vibrators of today. One reason is for not having tested lamination is that an exact analysis of the electro magnetic function of the bone conduction vibrators of today is practically impossible to carry out and consequently, nobody has explicitly pointed at the magnitude of the problem. It is first after considerable tests as the full potential of the present invention can be understood. Another reason for not having tested laminations may have been the fact that the problem of eddy currents have not been that large, as it is in the new constructions according to SE 0000810-2 and nobody has apparently thus tried to solve the problem in the way as proposed in the present invention. A third reason is also that laminations has been difficult to carry out from a manufacturing point of view and to a reasonable cost because conventional vibrators of today have circular symmetry.

The application of the present invention is not restricted to bone tissue transmitting hearing aids and audio meter vibrators but may also be used in other loud speaker applications and as vibration exciter or as a bone conduction microphone.

DETAILED DESCRIPTION

Figure 1:
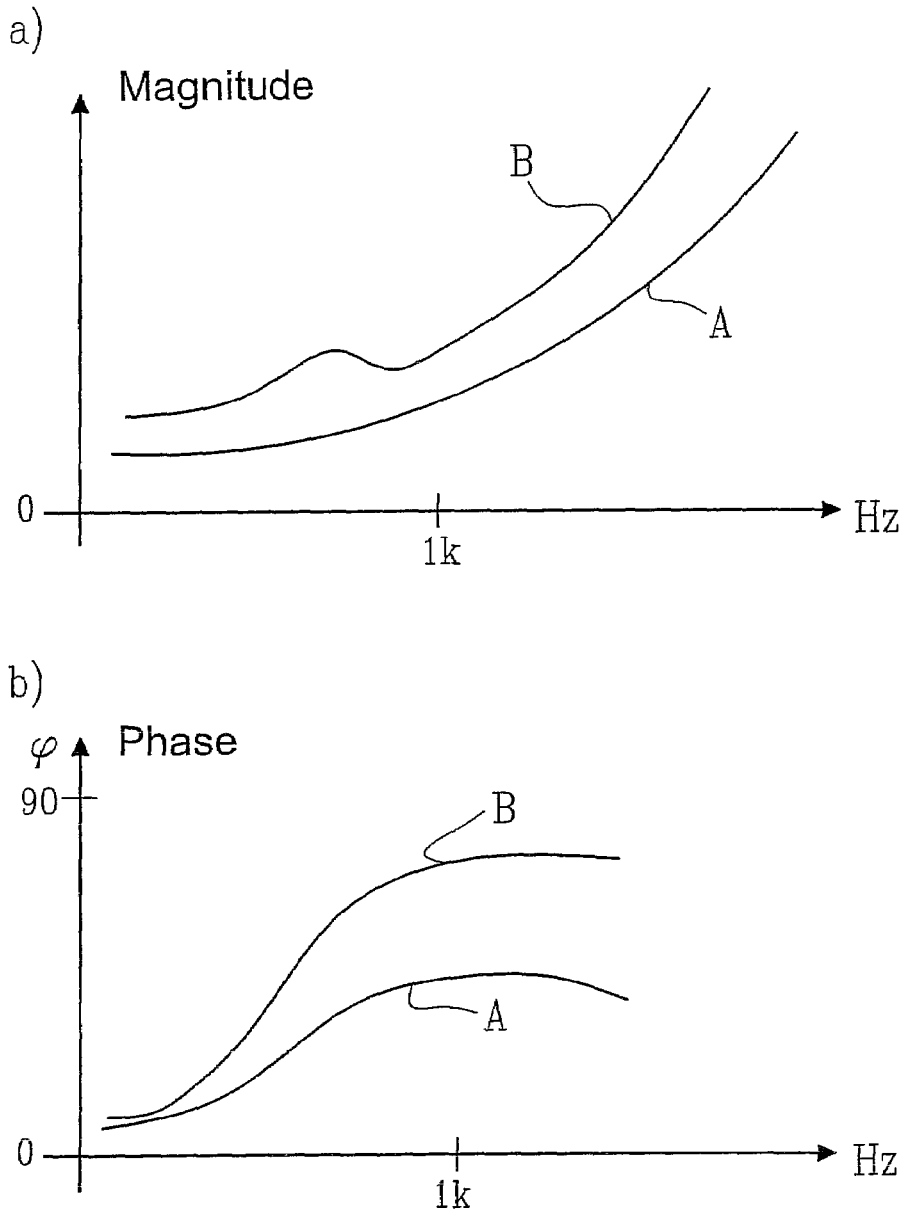
FIG. 1. The magnitude of the impedance (a) and phase (b) characteristics of a variable reluctance vibrator of known type (A) and according to the present invention (B)
Figure 2:
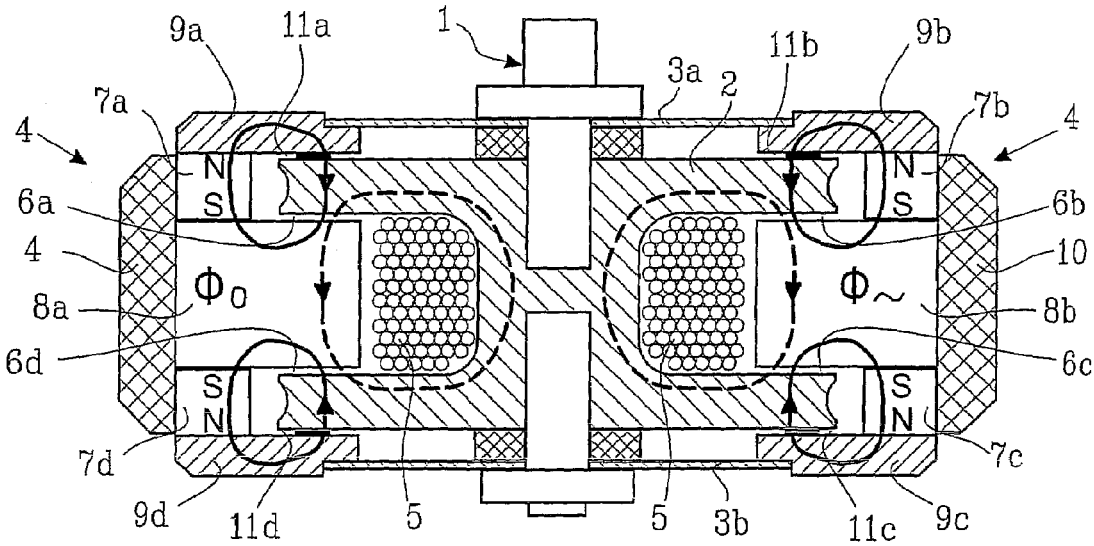
FIG. 2. Cross-section of a preferred embodiment of the invention.

In FIG. 2 a preferred exemplifying embodiment is shown which partly or completely solves the weaknesses of eddy current losses in vibrators for bone conduction use. The vibrator (1) has a rectangular symmetry. The H-formed bobbin body (2) is elastically suspended by means of two spring elements (3*a*, 3*b*) to the biasing flux unit (4). The signal flux $\phi_{\sim}$, being generated by current flowing in the coil (5) placed around the bobbin body/iron core, is circuited shortest possible way through the soft iron material and substantially through axial air gaps (6*a, b, c, d*) extending in the horizontal plane. The unit for creating a magnetic biasing flux (static flux from the permanent magnets) consists of four magnets (7*a, b, c, d*), two yokes (8*a, b*), four bias yokes (9*a, b, c, d*) and one counter mass (10). The four bias yokes can be designed in such a way that they (9*a, b*) is one integral unit, and (9*c, d*) is a second unit. Every magnet biases substantially the closest inner air gap (6*a, b, c, d*) with the bias flux $\phi_0$, which also flows through the outer air gaps (11*a, b, c, d*) and through the bias yokes (9*a, b, c, d*).

Figure 3:
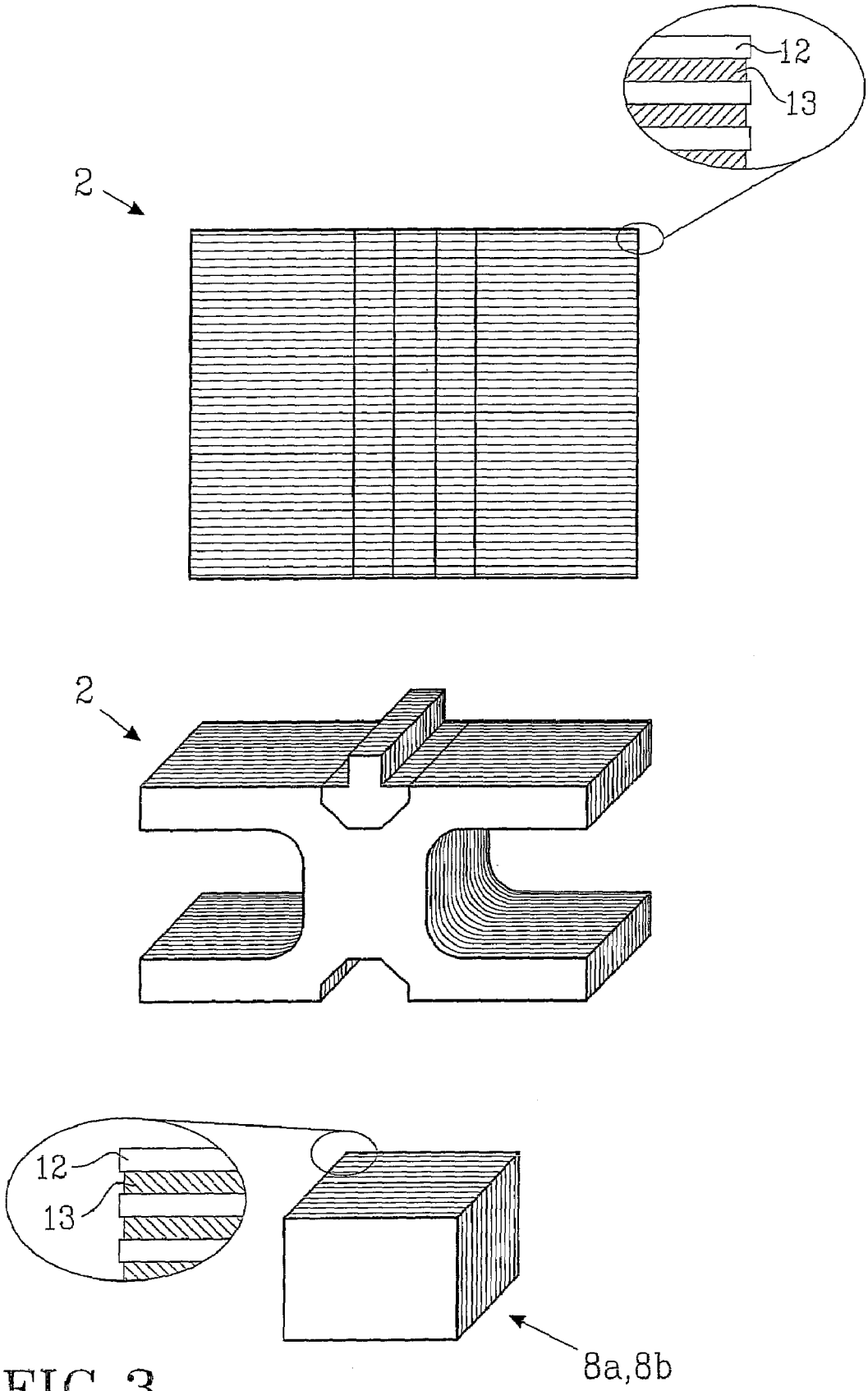
FIG. 3. Details from the preferred embodiment.

The H-formed core/bobbin body (2) around which the coil is placed is laminated as shown in FIG. 3. The lamination consists of sheets (12) having suitable magnetic properties and which joined using glue, which having a low electrical conductivity forms a thin layer (13) between the sheets. By means of the lamination thus the eddy currents, which arises in the radial plane around the dynamic flux running around in the iron material, is counteracted. If the H-formed body (2) is not laminated the eddy current losses will increase the temperature of the material considerably, which material due to its small size and weight easily will become overheated with a risk for short circuiting of the coil as a consequence. In order to further reducing eddy current losses even the two yokes (8*a, b*) can be designed as laminated units.

As mentioned in SE 0000810-2 the permanent magnets, in order to create the static bias flux, can be placed in a number of different ways. It is apparent that the bobbin body in these exemplifying embodiments can be made using rectangular symmetry and that they thereby can be laminated. Also, those yokes, which close the magnetic signal flux path, can be laminated.

Figure 4:
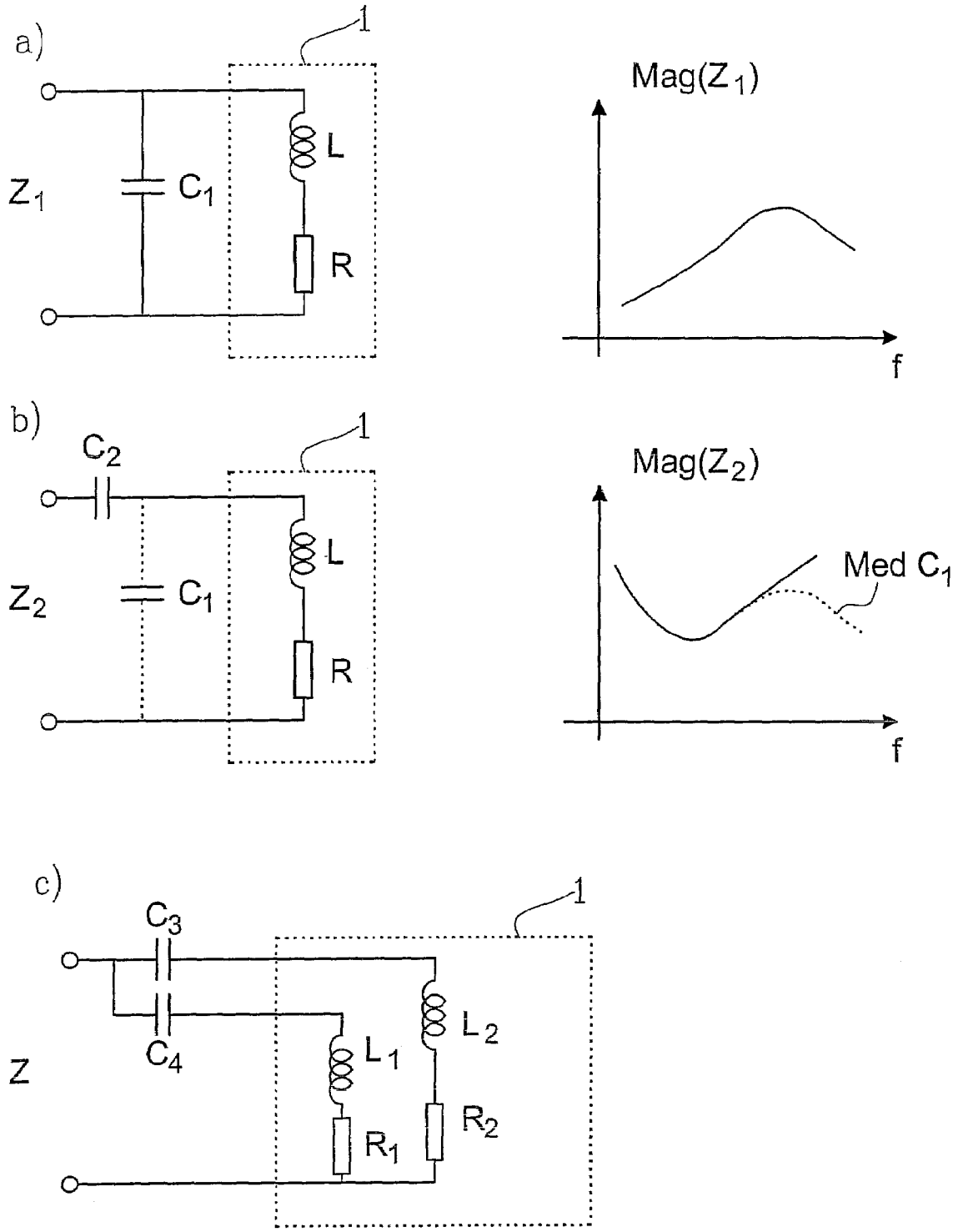
FIG. 4. Example of optimization of the present vibrator using external electrical components.

The electrical impedance of a vibrator according to the invention has a strong inductive characteristic and consists essentially of an inductance (L) and ohmic losses in the coil (R) according to the model of FIG. 4. Now, using relatively simple means the function of the vibrator can be optimized in certain, almost arbitrarily chosen frequency bands. For example, a capacitor ($C_1$) may be placed in parallel to the coil (1) to obtain a parallel resonance which means that the vibrator consumes an extremely little power at the resonance frequency according to FIG. 4*a*. This is of importance when useing digital power amplifiers, e.g., a class D amplifiers where one does not want the vibrator to consume power at the switch or carrier frequency. One may also place the capacitor ($C_2$) in series with the coil according to FIG. 4*b*. In this way one may by choosing a suitable value of the capacitor ($C_2$) obtain a very efficient electro magnetic transformation in a certain frequency band, e.g., in the speech frequency band. This solution using $C_2$ may be combined with using $C_1$ as shown in FIG. 4*b* where $C_1$ has been drawn in dashed lines. The capacitors $C_1$ and $C_2$ have leakage resistances which have not been shown in FIG. 4. The capacitors may have resistors in series or in parallel to themselves to obtain a desired dampening (Q-value). Finally, capacitors ($C_3$) and ($C_4$) may connected in series with the two different coils of the vibrator original coil is split into two parts winded in parallel, as shown in FIG. 2A and function as a cross-over network. One coil ($L_1$) is optimized for a good function in a frequency band, e.g., up to 1-2 kHz, and the other coil ($L_2$) is optimized for a good function in a neighbouring frequency band, e.g., above 1-2 kHz.

In spite of the fact the embodiments shown have been presented to describe the invention it is apparent that the one skilled in the art may modify, add or delete details without departing from the scope and idea of the invention, as defined by the following claims.

The invention claimed is:

1. A device for the generation of or monitoring of vibrations according to the principle of variable reluctance consisting comprising a coil for generating/monitoring a magnetic signal flux, a H-Formed bobbin body of a magnetic conducting material around which said coil is placed, one or more yokes of a magnetic conducting material and one or more permanent magnets for the generation of magnetic bias flux, wherein the H-Formed bobbin body consists of comprises thin layers having low electrical conductivity placed between laminated sheets of a magnetic conducting material for reduction of eddy current losses.

2. A device according to claim 1, wherein the one or more yokes comprise laminated sheets of a magnetic conducting material.

3. A device according to claim 1, wherein the sheets are joined using glue that forms a layer having low electric conductivity between the sheets.

4. A device according to claim 1, wherein the sheets are made by punching.

5. A device according to claim 1, wherein capacitive impedance is connected in parallel in such a way that a parallel resonance occurs in a frequency band where the device is not to consume any energy at a switch or carrier frequency.

6. A device according to claim 1, wherein a capacitive impedance is connected in series in such a way that a series resonance is obtained in a frequency band where an efficient transformation from electrical energy to mechanical energy is to be obtained.

7. A device according to claim 5, wherein capacitive impedance is connected in parallel in such a way that parallel resonance occurs and capacitive impedance is connected in series in such a way that a series resonance is obtained.

8. A device according to claim 1, wherein the coil is split into two parts and that a simple cross-over network is arranged to control the distribution of energy between the coils with regard to different frequency bands.

* * * * *